US006861380B2

(12) United States Patent
Garnier et al.

(10) Patent No.: US 6,861,380 B2
(45) Date of Patent: Mar. 1, 2005

(54) TISSUE PRODUCTS HAVING REDUCED LINT AND SLOUGH

(75) Inventors: Gil Bernard Didier Garnier, Neenah, WI (US); Sheng-Hsin Hu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/289,129

(22) Filed: Nov. 6, 2002

(65) Prior Publication Data

US 2004/0087237 A1 May 6, 2004

(51) Int. Cl.[7] ..... B32B 21/10

(52) U.S. Cl. ..... 442/413; 442/327; 442/361; 442/364; 442/381; 442/385; 442/415

(58) Field of Search ..... 442/327, 361, 442/364, 381, 385, 413, 415

(56) References Cited

U.S. PATENT DOCUMENTS

| | | | |
|---|---|---|---|
| 2,345,543 | A | 3/1944 | Wohnsiedler et al. |
| 2,745,744 | A | 5/1956 | Weidner et al. |
| 2,926,116 | A | 2/1960 | Keim |
| 2,926,154 | A | 3/1960 | Keim |
| 3,104,198 | A | 9/1963 | Brissette |
| 3,256,138 | A | 6/1966 | Welch et al. |
| 3,556,932 | A | 1/1971 | Coscia et al. |
| 3,556,933 | A | 1/1971 | Williams et al. |
| 3,700,623 | A | 10/1972 | Keim |
| 3,772,076 | A | 11/1973 | Keim |
| 3,812,000 | A | 5/1974 | Salvucci, Jr. et al. |
| 3,821,068 | A | 6/1974 | Shaw |
| 3,844,880 | A | 10/1974 | Meisel, Jr. et al. |
| 3,862,877 | A | 1/1975 | Camden |
| 3,879,257 | A | 4/1975 | Gentile et al. |
| 3,885,158 | A | 5/1975 | Flutie et al. |
| 3,899,388 | A | 8/1975 | Petrovich et al. |

(List continued on next page.)

FOREIGN PATENT DOCUMENTS

| | | | | |
|---|---|---|---|---|
| EP | 0404189 | A1 * | 12/1990 | ..... D21F/11/04 |
| EP | 0465203 | B1 | 1/1992 | |
| EP | 0951603 | B1 | 10/1999 | |
| EP | 1243697 | A1 | 9/2002 | |
| WO | WO 0021918 | A1 | 4/2000 | |
| WO | 0112902 | A1 | 2/2001 | |
| WO | 0202871 | A1 | 1/2002 | |
| WO | WO 0214606 | A2 | 2/2002 | |
| WO | WO 0214606 | A3 | 2/2002 | |
| WO | WO 0216689 | A2 | 2/2002 | |

OTHER PUBLICATIONS

PCT International Search Report, International Application No. PCT/US 03/21823, International Filing Date Jul. 10, 2003.

U.S. Appl. No. 10/319,415, filed Dec. 13, 2002, Garnier, et al.

*Primary Examiner*—Elizabeth M. Cole
*Assistant Examiner*—Norca L. Torres
(74) *Attorney, Agent, or Firm*—Dority & Manning, P.A.

(57) ABSTRACT

A tissue product containing a multi-layered paper web that has at least one layer formed from a blend of pulp fibers and synthetic fibers is provided. By containing at least one layer of synthetic and pulp fibers, it has been discovered that lint and slough of a tissue product formed according to the present invention can be substantially reduced. In addition, by limiting the amount and layers to which the synthetic fibers are applied, the increase in hydrophobicity and cost of the tissue product may be minimized, while still achieving the desired reduction in lint and slough. In some embodiments, the tendency of the synthetic fibers to sink or float in the fibrous furnish may be minimized to enhance processability by selecting certain types of synthetic fibers, e.g., those with a certain density imbalance.

33 Claims, 7 Drawing Sheets

U.S. PATENT DOCUMENTS 3,903,342 A 9/1975 Roberts, Jr.
3,994,771 A 11/1976 Morgan, Jr. et al.
4,018,647 A 4/1977 Wietsma
4,057,669 A 11/1977 McConnell
4,081,318 A 3/1978 Wietsma
4,099,913 A 7/1978 Walter et al.
4,121,966 A 10/1978 Amano et al.
4,129,528 A 12/1978 Petrovich et al.
4,147,586 A 4/1979 Petrovich et al.
4,158,594 A 6/1979 Becker et al.
4,208,459 A 6/1980 Becker et al.
4,222,921 A 9/1980 Van Eenam
4,237,818 A 12/1980 Clifford et al.
4,351,699 A 9/1982 Osborn, III
4,392,861 A * 7/1983 Butterworth et al. ..... 604/366
4,441,962 A 4/1984 Osborn, III
4,447,294 A 5/1984 Osborn, III
4,507,173 A 3/1985 Klowak et al.
4,510,019 A 4/1985 Bartelloni
4,581,254 A 4/1986 Cunningham et al.
4,603,176 A 7/1986 Bjorkquist et al.
4,604,313 A 8/1986 McFarland et al.
4,605,702 A 8/1986 Guerro et al.
4,755,421 A * 7/1988 Manning et al. ..... 442/338
4,795,668 A 1/1989 Krueger et al.
4,822,452 A 4/1989 Tse et al.
4,849,054 A 7/1989 Klowak
4,925,528 A 5/1990 Tse et al.
4,940,513 A 7/1990 Spendel
4,959,125 A 9/1990 Spendel
5,019,211 A 5/1991 Sauer
5,048,589 A 9/1991 Cook et al.
5,057,368 A 10/1991 Largman et al.
5,069,970 A 12/1991 Largman et al.
5,094,717 A 3/1992 Manning et al.
5,102,501 A 4/1992 Eber et al.
5,108,820 A 4/1992 Kaneko et al.
5,129,988 A 7/1992 Farrington, Jr.
5,162,074 A 11/1992 Hills
5,164,046 A 11/1992 Ampulski et al.
5,167,765 A 12/1992 Nielsen et al.
5,238,534 A 8/1993 Manning et al.
5,240,562 A 8/1993 Phan et al.
5,277,976 A 1/1994 Hogle et al.
5,336,552 A 8/1994 Strack et al.
5,382,400 A 1/1995 Pike et al.
5,385,643 A 1/1995 Ampulski
5,397,435 A 3/1995 Ostendorf et al.
5,399,412 A 3/1995 Sudall et al.
5,405,501 A 4/1995 Phan et al.
5,409,768 A * 4/1995 Dickenson et al. ..... 442/389
5,427,696 A 6/1995 Phan et al.
5,437,766 A 8/1995 Van Phan et al.
5,466,337 A 11/1995 Darlington et al.
5,466,410 A 11/1995 Hills
5,494,554 A 2/1996 Edwards et al.
5,510,000 A 4/1996 Phan et al.
5,510,001 A 4/1996 Hermans et al.
5,529,665 A 6/1996 Kaun
5,543,067 A 8/1996 Phan et al.
5,558,873 A 9/1996 Funk et al.
5,591,309 A 1/1997 Rugowski et al.
5,667,636 A 9/1997 Engel et al.
5,716,498 A 2/1998 Jenny et al.
5,730,839 A 3/1998 Wendt et al.
5,846,380 A 12/1998 Van Phan et al.
5,851,352 A 12/1998 Vinson et al.
5,853,539 A 12/1998 Smith et al.
5,885,418 A 3/1999 Anderson et al.
5,935,383 A 8/1999 Sun et al.
5,981,044 A 11/1999 Phan et al.
5,981,410 A 11/1999 Hansen et al.
5,985,434 A 11/1999 Qin et al.
5,989,682 A 11/1999 Anderson
5,993,602 A 11/1999 Smith et al.
6,017,417 A 1/2000 Wendt et al.
6,017,418 A 1/2000 Oriaran et al.
6,096,152 A 8/2000 Anderson et al.
6,129,815 A 10/2000 Larson et al.
6,200,669 B1 3/2001 Marmon et al.
6,211,139 B1 4/2001 Keys et al.
6,231,719 B1 5/2001 Garvey et al.
6,241,850 B1 6/2001 Kelly
6,248,211 B1 6/2001 Jennings et al.
6,248,212 B1 6/2001 Anderson et al.
6,261,580 B1 7/2001 Lehrter et al.
6,277,241 B1 8/2001 Merker et al.
6,315,864 B2 11/2001 Anderson et al.
6,328,850 B1 12/2001 Phan et al.
6,368,609 B1 4/2002 Fontenot et al.
6,387,495 B1 5/2002 Reeves et al.
6,423,180 B1 7/2002 Behnke et al.
6,432,270 B1 8/2002 Liu et al.
6,500,289 B2 12/2002 Merker et al.
6,534,151 B2 3/2003 Merker
2002/0088592 A1 * 7/2002 Drew et al. ..... 162/297
2003/0131962 A1 7/2003 Lindsay et al.

* cited by examiner

TISSUE PRODUCTS HAVING REDUCED LINT AND SLOUGH

BACKGROUND OF THE INVENTION

Tissue products, such as facial tissues, paper towels, bath tissues, sanitary napkins, and other similar products, are designed to include several important properties. For example, the products should have good bulk, a soft feel, and should have good strength. Unfortunately, however, when steps are taken to increase one property of the product, other characteristics of the product are often adversely affected.

For example, during a papermaking process, it is common to use various resins to increase the wet strength of the web. Cationic resins, for example, are often used because they are believed to more readily bond to the anionically charged cellulosic fibers. Although strength resins can increase the strength of the web, they also tend to stiffen the web, which is often undesired by consumers. Thus, various methods are often used to counteract this stiffness and to soften the product. For example, chemical debonders can be utilized to reduce fiber bonding and thereby increase softness.

Nevertheless, reducing fiber bonding with a chemical debonder can sometimes adversely affect the strength of the tissue product. For example, hydrogen bonds between adjacent fibers can be broken by such chemical debonders, as well as by mechanical forces of a papermaking process. Consequently, such debonding results in loosely bound fibers that extend from the surface of the tissue product. During processing and/or use, these loosely bound fibers can be freed from the tissue product, thereby creating lint, which is defined as individual airborne fibers and fiber fragments. Moreover, papermaking processes may also create zones of fibers that are poorly bound to each other but not to adjacent zones of fibers. As a result, during use, certain shear forces can liberate the weakly bound zones from the remaining fibers, thereby resulting in slough, i.e., bundles or pills on surfaces, such as skin or fabric. Thus, the use of such debonders can often result in a much weaker paper product during use that exhibits substantial amounts of lint and slough.

As such, a need currently exists for a tissue product that is strong, soft, and that also has low lint and slough.

SUMMARY OF THE INVENTION

In accordance with one embodiment of the present invention, a tissue product is disclosed that comprises at least one multi-layered paper web that includes a first fibrous layer and a second fibrous layer. The first fibrous layer comprises hardwood pulp fibers and the second fibrous layer comprises softwood fibers. Synthetic fibers are present within the first and/or second fibrous layers in an amount from about 0.1% to about 25% by weight of the layer, in some embodiments from about 0.1% to about 10% by weight of the layer, and in some embodiments, from about 2% to about 5% by weight of the layer. If desired, the synthetic fibers may have a length of from about 0.5 to about 30 millimeters, and in some embodiments, from about 4 to about 8 millimeters. Such a relatively long fiber length may facilitate the reduction of lint and slough by entangling the relatively short hardwood or softwood pulp fibers.

Generally speaking, the total amount of synthetic fibers present within the web is from about 0.1% to about 20% by weight, in some embodiments from about 0.1% to about 10% by weight, and in some embodiments, from about 0.1% to about 2% by weight. If desired, the density imbalance of the synthetic fibers ($\Delta\rho=\rho_{water}-\rho_{fibers}$) may be from about −0.2 to about +0.5 grams per cubic centimeter, in some embodiments from about −0.2 to about +0.4 grams per cubic centimeter, and in some embodiments, from about −0.1 to about +0.4 grams per cubic centimeter.

In accordance with another embodiment of the present invention, a single-ply tissue product is disclosed that comprises an inner layer positioned between a first outer layer and a second outer layer. The inner layer comprises softwood fibers and the first and second outer layers comprise hardwood pulp fibers. Synthetic fibers are present in the first outer layer, the second outer layer, and/or the inner layer in an amount from about 0.1% to about 25% by weight of the layer so that the total amount of synthetic fibers present within the tissue product is from about 0.1% to about 20% by weight. The synthetic fibers have a density imbalance of from about −0.1 to about +0.4 grams per cubic centimeter.

In accordance with still another embodiment of the present invention, a multi-ply tissue product is disclosed that comprises:

(a) a first ply, the first ply comprising:
- a first fibrous layer, wherein the first fibrous layer comprises hardwood pulp fibers; and
- a second fibrous layer positioned adjacent to said first fibrous layer, the second fibrous layer comprising softwood pulp fibers, wherein the first fibrous layer, the second fibrous layer, or combinations thereof, further comprise synthetic fibers in an amount from about 0.1% to about 25% by weight of the layer so that the total amount of synthetic fibers present within the web is from about 0.1% to about 20% by weight, wherein the synthetic fibers have a density imbalance of from about −0.1 to about +0.4 grams per cubic centimeter;

(b) a second ply comprising at least one fibrous layer.

In accordance with still another embodiment of the present invention, a multi-ply tissue product is disclosed that comprises:

(a) a first ply, the first ply comprising:
- a first outer layer that comprises hardwood pulp fibers, softwood fibers, or combinations thereof;
- a second outer layer that comprises hardwood pulp fibers, softwood pulp fibers, or combinations thereof; and
- an inner layer positioned between the first fibrous layer and the second fibrous layer, the inner layer comprising hardwood pulp fibers, softwood pulp fibers, or combinations thereof, wherein the inner layer, the first outer layer, the second outer layer, or combinations thereof, further comprise synthetic fibers in an amount from about 0.1% to about 25% by weight of the layer so that the total amount of synthetic fibers present within the web is from about 0.1% to about 20% by weight, wherein the synthetic fibers have a density imbalance of from about −0.1 to about +0.4 grams per cubic centimeter;

(b) a second ply comprising at least one fibrous layer.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
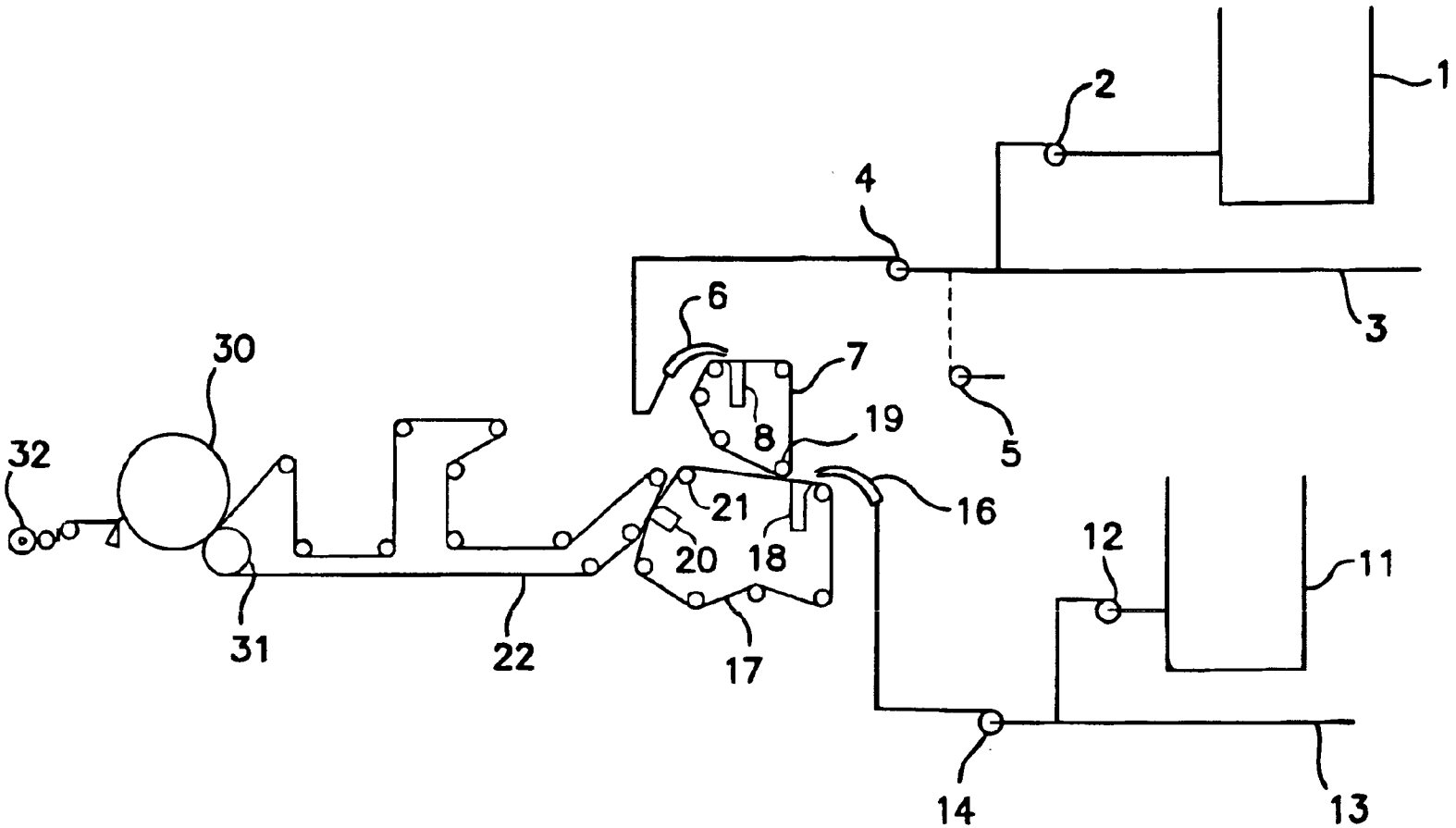
FIG. 1 is a schematic flow diagram of one embodiment of a papermaking process that can be used in the present invention.

Repeat use of reference characters in the present specification and drawings is intended to represent same or analogous features or elements of the present invention.

DETAILED DESCRIPTION OF REPRESENTATIVE EMBODIMENTS

Definitions

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.5 millimeters as determined by an optical fiber analyzer such as, for example, a Kajaani fiber analyzer Model No. FS-100 (Kajaani Oy Electronics, Kajaani, Finland). For example, low average fiber length pulps may have an average fiber length ranging from about 0.7 to about 1.2 millimeters. Exemplary low average fiber length pulps include virgin hardwood pulp, and secondary fiber pulp from sources such as, for example, office waste, newsprint, and paperboard scrap.

As used herein, the term "high-average fiber length pulp" refers to pulp that contains a relatively small amount of short fibers and non-fiber particles. High-average fiber length pulp is typically formed from certain non-secondary (i.e., virgin) fibers. Secondary fiber pulp that has been screened may also have a high-average fiber length. High-average fiber length pulps typically have an average fiber length of greater than about 1.5 millimeters as determined by an optical fiber analyzer such as, for example, a Kajaani fiber analyzer Model No. FS-100 (Kajaani Electronics, Kajaani, Finland). For example, a high-average fiber length pulp may have an average fiber length from about 1.5 millimeters to about 6 millimeters. Exemplary high-average fiber length pulps that are wood fiber pulps include, for example, bleached and unbleached virgin softwood fiber pulps.

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 grams per square meter, and In some embodiments, between about 10 to about 60 gsm.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a tissue product containing a multi-layered paper web that has at least one layer formed from a blend of pulp fibers and synthetic fibers. By containing at least one layer of synthetic and pulp fibers, it has been discovered that lint and slough of a tissue product formed according to the present invention can be substantially reduced. In addition, by limiting the amount and layers to which the synthetic fibers are applied, the increase in hydrophobicity and cost of the tissue product may be minimized, while still achieving the desired reduction in lint and slough. In some embodiments, the tendency of the synthetic fibers to sink or float in the fibrous furnish may be minimized to enhance processability by selecting certain types of synthetic fibers, e.g., those with a certain density imbalance.

The tissue product of the present invention contains at least one multi-layered paper web. The tissue product can be a single-ply tissue product in which the web forming the tissue is stratified, i.e., has multiple layers, or a multi-ply tissue product in which the webs forming the multi-ply tissue product may themselves be either single or multi-layered. If desired, the layers may also include blends of various types of fibers. However, it should be understood that the tissue product can include any number of plies or layers and can be made from various types of fibers.

Regardless of the exact construction of the tissue product, at least one layer of a multi-layered paper web incorporated into the tissue product is formed with a blend of pulp fibers and synthetic fibers. The pulp fibers may include fibers formed by a variety of pulping processes, such as kraft pulp, sulfite pulp, thermomechanical pulp, etc. Further, the pulp fibers may have any high-average fiber length pulp, low-average fiber length pulp, or mixtures of the same. One example of suitable high-average length pulp fibers include softwood fibers such as, but not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19". One example of suitable low-average length fibers include hardwood fibers, such as, but not limited to, eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In addition, synthetic fibers are also utilized in one or more layers of the multi-layered paper web to help reduce the production of lint or slough in the resulting tissue product. Some suitable polymers that may be used to form the synthetic fibers include, but are not limited to, polyolefins, e.g., polyethylene, polypropylene, polybutylene, and the like; polytetrafluoroethylene; polyesters, e.g., polyethylene terephthalate and the like; polyvinyl acetate; polyvinyl chloride acetate; polyvinyl butyral; acrylic resins, e.g., polyacrylate, polymethylacrylate, polymethylmethacrylate, and the like; polyamides, e.g., nylon; polyvinyl chloride; polyvinylidene chloride; polystyrene; polyvinyl alcohol; polyurethanes; polylactic acid; and the like. If desired, biodegradable polymers, such as poly(glycolic acid) (PGA), poly(lactic acid) (PLA), poly(β-malic acid) (PMLA), poly(ε-caprolactone) (PCL), poly(ρ-dioxanone) (PDS), and poly(3-hydroxybutyrate) (PHB), may also be utilized. The polymer (s) used to form the synthetic fibers may also include synthetic and/or natural cellulosic polymers, such as cellulosic esters, cellulosic ethers, cellulosic nitrates, cellulosic acetates, cellulosic acetate butyrates, ethyl cellulose, regenerate celluloses (e.g., viscose, rayon, etc.).

In one particular embodiment, the synthetic fibers are multicomponent fibers. Multicomponent fibers are fibers that have been formed from two or more thermoplastic polymers and that may be extruded from separate extruders, but spun together, to form one fiber. Multicomponent fibers may have a side-by-side arrangement, a sheath/core arrangement (e.g., eccentric and concentric), a pie wedge arrangement, a hollow pie wedge arrangement, island-in-the-sea, three island, bull's eye, or various other arrangements known in the art. In a sheath/core bicomponent fiber, for instance, a first polymer component is surrounded by a second polymer component, The polymers of these bicomponent fibers are arranged in substantially constantly positioned distinct zones across the cross-section of the bicomponent fiber and extend continuously along the length of the fibers. Multicomponent fibers and methods of making the same are taught in U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. The fibers and individual components containing the same may also have various irregular shapes such as those described in U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

Although any combinations of polymers may be used to form the multicomponent fibers, the polymers of the multicomponent fibers are typically made up of thermoplastic materials with different glass transition or melting temperatures, such as for example, polyolefin/polyester (sheath/core) or polyester/polyester multicomponent fibers where the sheath melts at a temperature lower than the core. Softening or melting of the first polymer component of the multicomponent fiber allows the multicomponent fibers to form a tacky skeletal structure, which upon cooling, captures and binds many of the pulp fibers. For example, the multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer. One commercially available example of a bicomponent fiber that may be used in the present invention is AL-Adhesion-C, a polyethylene/polypropylene sheath/core fiber available from ES Fibervision, Inc. of Athens, Ga. Another commercially example of a suitable bicomponent fiber is Celbond® Type 105, a polyethylene/polyester sheath/core fiber available from Kosa, inc. of Salisbury, N.C. Other suitable commercially available bicomponent fibers include polyethylene and polypropylene synthetic pulp fibers available from Minifibers, Inc. of Johnson City, Tenn.

Synthetic fibers may help reduce lint and slough in a variety of ways. For instance, the synthetic fibers can soften and fuse to themselves and the pulp fibers upon heating (e.g., thermofusing), thereby creating a continuous or semi-continuous network within the layer of the web. This network can help prevent zones of cellulosic fibers from being removed from the web layer as lint or slough. In addition, due to their relatively long nature, the synthetic fibers tend to entangle with the pulp fibers, thereby further inhibiting the removal of the pulp fibers as lint or slough. For instance, the synthetic fibers typically have a length of from about 0.5 to about 30 millimeters, in some embodiments from about 4 to about 12 millimeters, and in some embodiments, from about 4 to about 8 millimeters. In addition, the synthetic fibers may have a denier of from about 0.5 to about 10, in some embodiments from about 1 to about 5, and in some embodiments, from about 1 to about 3.

Further, the synthetic fibers may also be selected to have a "density imbalance" within a predetermined range. "Density imbalance" is defined as the density of water minus the density of the fibers ($\Delta\rho=\rho_{water}-\rho_{fibers}$). If the density imbalance is too high (e.g., positive), the fibers tend to float in water during the papermaking process so that a counter-acting fiber surface treatment is required to "sink" the fibers to a desired extent into the cellulosic fibrous furnish for uniform mixing therewith. If the density imbalance is too low, the fibers tend to sink in water during the papermaking process so that a counter-acting fiber surface treatment is required to "raise" the fibers to a desired extent for uniform mixing with the cellulosic fibrous furnish. Thus, although not required, the density of the synthetic fibers typically remains close to the density of water so that the density imbalance is from about −0.2 to about +0.5 grams per cubic centimeter (g/cm$^3$), in some embodiments from about −0.2 to about +0.4 g/cm$^3$, and in some embodiments, from about −0.1 to about +0.4 g/cm$^3$, to facilitate processing of the paper web.

The amount of the synthetic fibers present within a layer of the multi-layered paper web may generally vary depending on the desired properties of the tissue product. For instance, the use of a large amount of synthetic fibers typically results in a tissue product that has very little lint and slough, but that is also relatively costly and more hydrophobic. Likewise, the use of a low amount of synthetic fibers typically results in a tissue product that is inexpensive and very hydrophilic, but that also generates a higher amount of lint and slough. Thus, although not required, the synthetic fibers typically constitute from about 0.1% to about 25%, in some embodiments from about 0.1% to about 10%, in some embodiments from about 2% to about 8%, and in some embodiments, from about 2% to about 5% of the dry weight of fibrous material synthetic fibers of a given layer. Further, in some embodiments, the synthetic fibers typically constitute from about 0.1% to about 20%, in some embodiments from about 0.1% to about 10%, in some embodiments from about 0.1% to about 5%, and in some embodiments, from about 0.1% to about 2% of the dry weight of the entire web.

The properties of the resulting tissue product may be varied by selecting particular layer(s) for incorporation of the synthetic fibers. For example, in some embodiments, the synthetic fibers may be incorporated into a hardwood fiber outer layer of a tissue product and/or into a softwood fiber inner layer of a tissue product. Further, if desired, the increase in web hydrophobicity and cost sometimes encountered with synthetic fibers can be reduced by restricting application of the synthetic fibers to only a single layer of the web. For instance, in one embodiment, a three-layered paper web can be formed in which each outer layer contains pulp fiber and synthetic fibers, while the inner layer is substantially free of synthetic fibers. In another embodiment, the outer layers of a three-layered web can be substantially free of synthetic fibers. It should be understood that, when referring to a layer that is substantially free of synthetic fibers, minuscule amounts of the fibers may be present therein. However, such small amounts often arise from the synthetic fibers applied to an adjacent layer, and do not typically substantially affect the hydropobicity of the tissue product.

Figure 5:
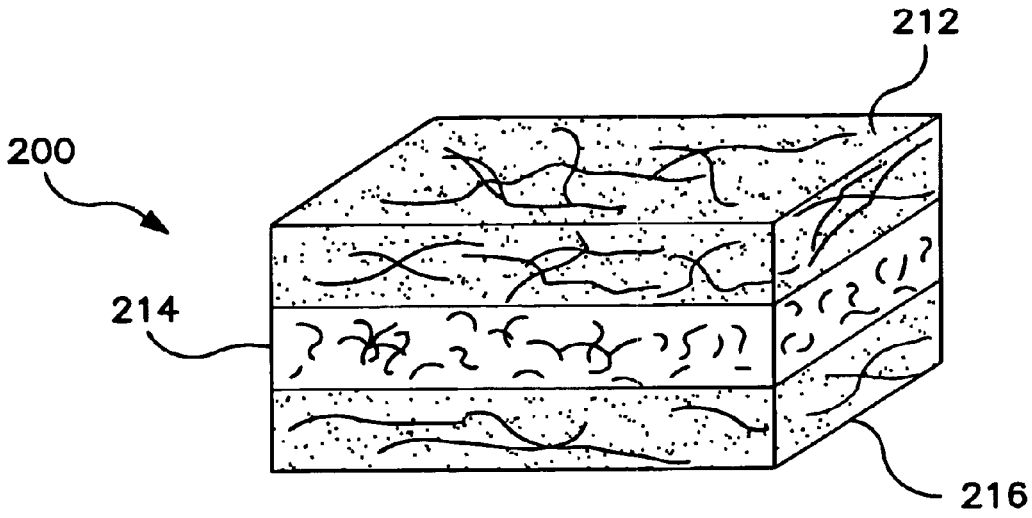
FIG. 5 illustrates one embodiment of a single ply tissue product formed according to the present invention.

As indicated above, the synthetic fibers are generally blended with pulp fibers and incorporated into one or more layers of a multi-layered paper web. For instance, as shown in FIG. 5, one embodiment of the present invention includes the formation of a single ply tissue product 200. In this embodiment, the single ply is a paper web having three layers 212, 214, and 216. The outer layers 212 and/or 216 may contain synthetic fibers, such as described above. For example, in one embodiment, both outer layers 212 and 216 contain a blend of about 95% hardwood fibers and about 5% synthetic fibers, such that the total fiber content of the layer 212 represents about 33% by weight of the tissue product 200 and the total fibers content of the layer 216 represents about 32% by weight of the tissue product 200. In addition, the inner layer 214 includes about 100% softwood fibers such that the total fiber content of the layer 214 represents about 35% by weight of the tissue product 200.

Figure 6:
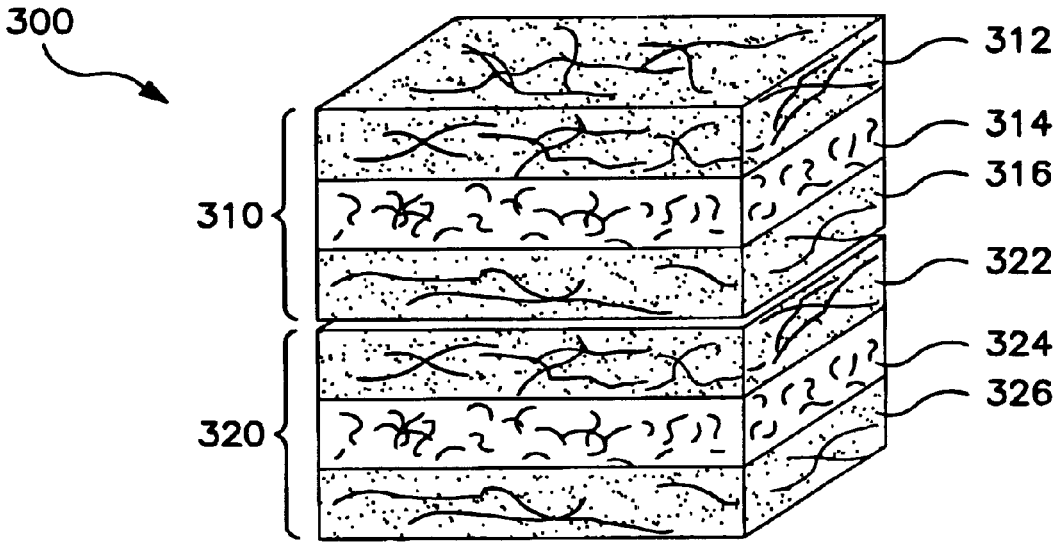
FIG. 6 illustrates one embodiment of a two ply tissue product formed according to the present invention.

Referring to FIG. 6, one embodiment of a two-ply tissue product 300 is shown. In this embodiment, the tissue product 300 contains an upper multi-layered paper web 310 and a lower multi-layered paper web 320 that are plied together using well-known techniques. The upper web 310 contains three layers 312, 314, and 316. For example, in one embodiment, the outer layer 312 contains a blend of about 95% hardwood fibers and about 5% synthetic fibers, such that the total fiber content of the layer 312 represents about 33% by weight of web 310. In addition, the layer 316 contains about 100% hardwood fibers and represents about 32% by weight of the web 310 and the layer 314 includes about 100% softwood fibers and represents 35% by weight of the web 310. On the other hand, the lower paper web 320 contains a layer 322 of hardwood fibers, a layer 324 of softwood fibers, and a layer 326 of hardwood fibers and synthetic fibers, constituting about 33%, about 35%, and about 32% of the web 320, respectively. Similar to the layer 312, the layer 326 contains 5% synthetic fibers and 95% hardwood fibers.

Figure 7:
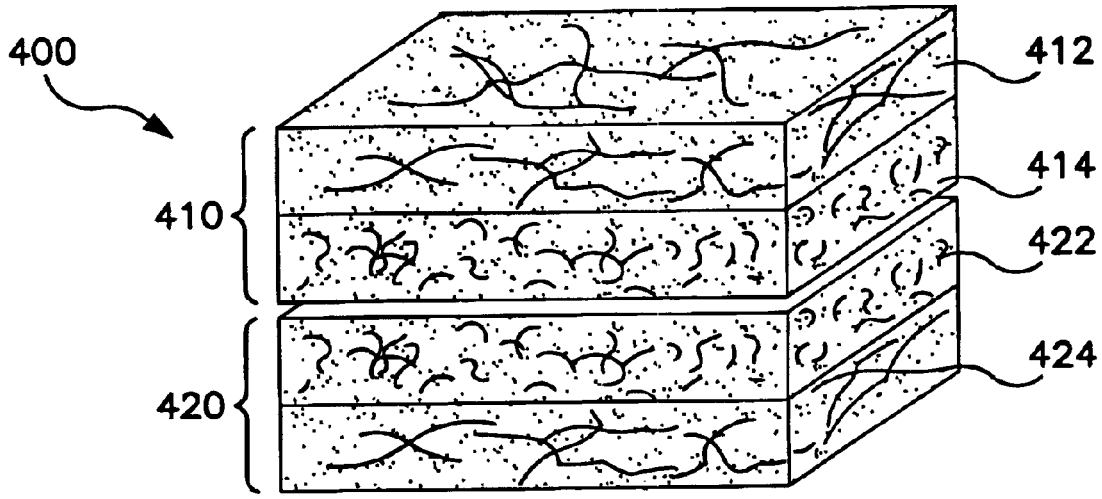
FIG. 7 illustrates another embodiment of a two ply tissue product formed according to the present invention.

Referring to FIG. 7, still another embodiment of a two-ply tissue product 400 is shown. In this embodiment, the tissue product 400 contains an upper multi-layered paper web 410 and a lower multi-layered paper web 420 that are plied together using well-known techniques. The upper web 410 contains two layers 412 and 414. For example, in one embodiment, the layer 412 contains a blend of about 95% hardwood fibers and about 5% synthetic fibers, such that the total fiber content of the layer 412 represents about 35% by weight of web 410. In addition, the layer 414 contains about 50% hardwood fibers and 50% softwood fibers and represents about 65% by weight of the web 410. The lower paper web 420 contains a layer 422 of about 50% hardwood fibers and 50% softwood fibers and a layer 424 of about 95% hardwood fibers and about 5% synthetic fibers, constituting about 65% and about 35% of the web 420, respectively.

Figure 8:
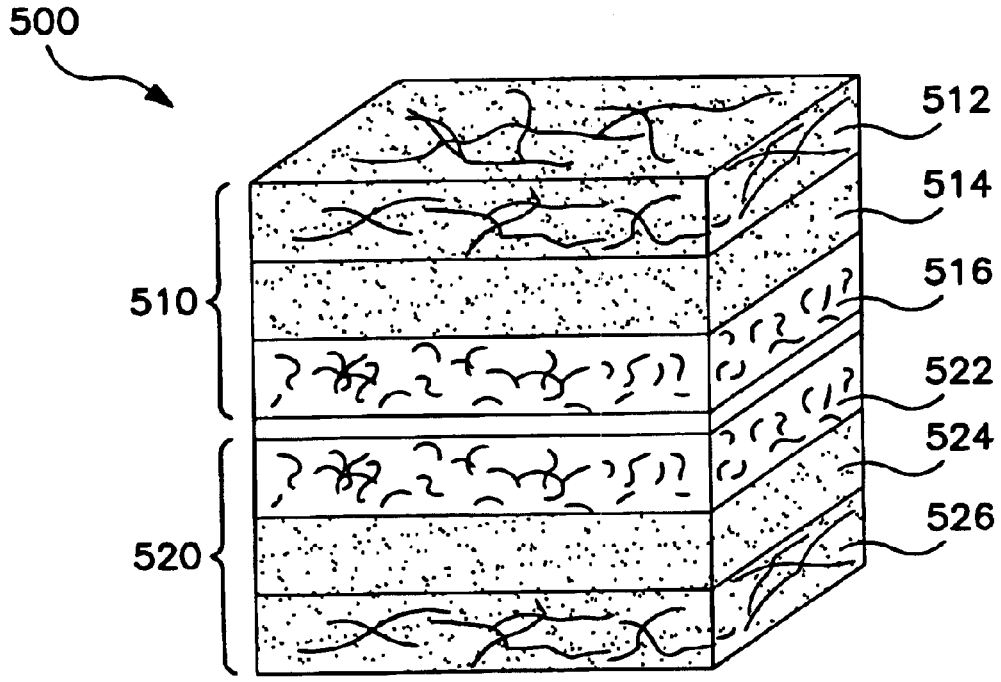
FIG. 8 illustrates another embodiment of a two ply tissue product formed according to the present invention.

Referring to FIG. 8, another embodiment of a two-ply tissue product 500 is shown. In this embodiment, the tissue product 500 contains an upper multi-layered paper web 510 and a lower multi-layered paper web 520 that are plied together using well-known techniques. The upper web 510 contains three layers 512, 514, and 516. For example, in one embodiment, the outer layer 512 contains a blend of about 95% hardwood fibers and about 5% synthetic fibers, such that the total fiber content of the layer 512 represents about 20% by weight of web 510. In addition, the layer 514 contains about 100% hardwood fibers and represents about 45% by weight of the web 510 and the layer 516 includes about 100% softwood fibers and represents 35% by weight of the web 510. On the other hand, the lower paper web 520 contains a layer 522 of softwood fibers, a layer 524 of hardwood fibers, and a layer 526 of hardwood fibers and synthetic fibers, constituting about 35%, about 45%, and about 20% of the web 520, respectively. Similar to the layer 512, the layer 526 contains 5% synthetic fibers and 95% hardwood fibers.

Figure 9:
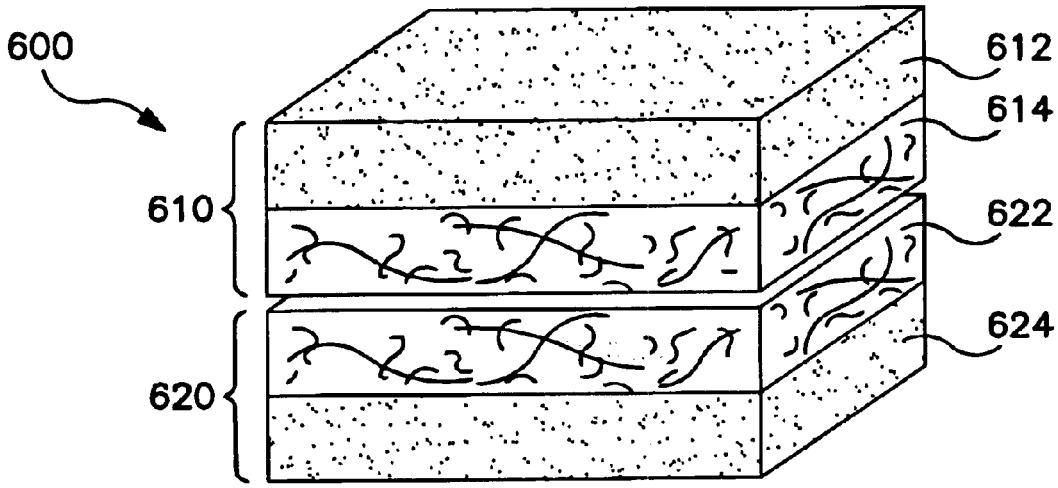
FIG. 9 illustrates another embodiment of a two ply tissue product formed according to the present invention.

Referring to FIG. 9, still another embodiment of a two-ply tissue product 600 is shown. In this embodiment, the tissue product 600 contains an upper multi-layered paper web 610 and a lower multi-layered paper web 620 that are plied together using well-known techniques. The upper web 610 contains two layers 612 and 614. For example, in one embodiment, the layer 612 contains 100% hardwood fibers such that the total fiber content of the layer 612 represents about 65% by weight of web 610. In addition, the layer 614 contains about 5% synthetic fibers and 95% softwood fibers and represents about 35% by weight of the web 610. On the other hand, the lower paper web 620 contains a layer 624 of about 100% hardwood fibers and a layer 622 of about 5% synthetic fibers and 95% softwood fibers, constituting about 65% and about 35% of the web 620, respectively.

Figure 10:
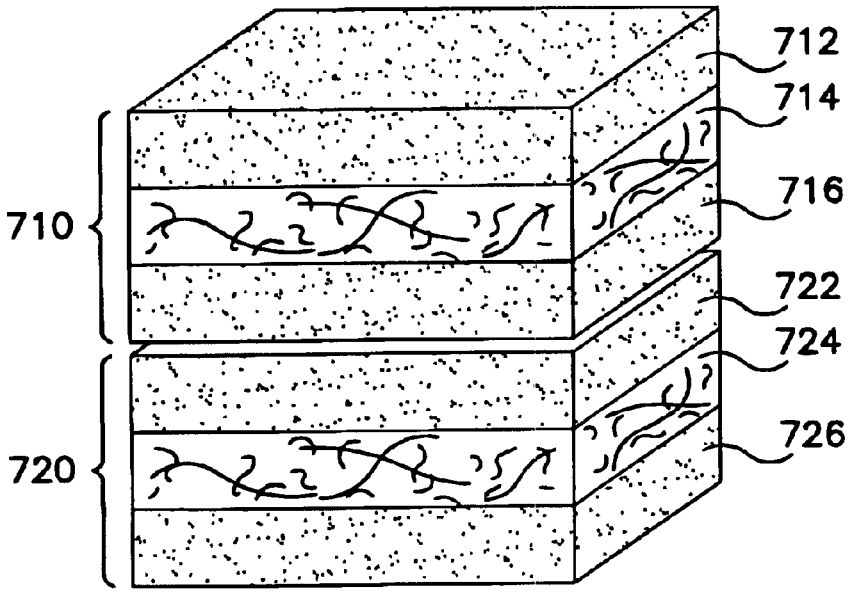
FIG. 10 illustrates another embodiment of a two ply tissue product formed according to the present invention.

Referring to FIG. 10, yet another embodiment of a two-ply tissue product 700 is shown. In this embodiment, the tissue product 700 contains an upper multi-layered paper web 710 and a lower multi-layered paper web 720 that are plied together using well-known techniques. The upper web 710 contains three layers 712, 714, and 716. For example, in one embodiment, the outer layer 712 contains 100% hardwood fibers such that the total fiber content of the layer 712 represents about 33% by weight of web 710. In addition, the layer 714 contains a blend of 5% synthetic fibers and 95% softwood fibers and represents about 35% by weight of the web 710 and the layer 716 includes about 100% hardwood fibers and represents 32% by weight of the web 710. On the other hand, the lower paper web 720 contains a layer 722 of hardwood fibers, a layer 724 of 5% synthetic fibers and 95% softwood fibers, and a layer 726 of hardwood fibers, constituting about 33%, about 35%, and about 32% of the web 720, respectively. Although various constructions of the tissue product are described above, it should be understood that many other constructions are also contemplated by the present invention. In fact, any tissue product that includes at least one outer surface defined by a layer that contains pulp and synthetic fibers is included within the present invention.

If desired, various chemical compositions may be applied to one or more layers of the multi-layered paper web to further enhance softness and/or reduce the generation of lint or slough. For example, in some embodiments, a wet strength agent can be utilized, to further increase the strength of the tissue product. As used herein, a "wet strength agent" is any material that, when added to cellulosic fibers, can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 pound per ton (lb/T) to about 60 lb/T, in some embodiments, between about 5 lb/T to about 30 lb/T, and in some embodiments, between about 7 lb/T to about 13 lb/T of the dry weight of fibrous material. The wet strength agents can be incorporated into any layer of the multi-layered paper web.

Suitable permanent wet strength agents are typically water soluble, cationic oligomeric or polymeric resins that are capable of either crosslinking with themselves (homocrosslinking) or with the cellulose or other constituents of the wood fiber. Examples of such compounds are described in U.S. Pat. Nos. 2,345,543; 2,926,116; and 2,926,154, which are incorporated herein in their entirety by reference thereto for all purposes. One class of such agents includes polyamine-epichlorohydrin, polyamide epichlorohydrin or polyamide-amine epichlorohydrin resins, collectively termed "PAE resins". Examples of these materials are described in U.S. Pat. No. 3,700,623 to Keim and U.S. Pat. No. 3,772,076 to Keim, which are incorporated herein in their entirety by reference thereto for all purposes and are sold by Hercules, Inc., Wilmington, Del. under the trade designation "Kymene", e.g., Kymene 557H or 557 LX. Kymene 557 LX, for example, is a polyamide epicholorohydrin polymer that contains both cationic sites, which can form ionic bonds with anionic groups on the pulp fibers, and azetidinium groups, which can form covalent bonds with carboxyl groups on the pulp fibers and crosslink with the polymer backbone when cured.

Other suitable materials include base-activated polyamide-epichlorohydrin resins, which are described in U.S. Pat. No. 3,885,158 to Petrovich; U.S. Pat. No. 3,899,388 to Petrovich; U.S. Pat. No. 4,129,528 to Petrovich; U.S. Pat. No. 4,147,586 to Petrovich; and U.S. Pat. No. 4,222,921 to van Eanam, which are incorporated herein in their entirety by reference thereto for all purposes. Polyethylenimine resins may also be suitable for immobilizing fiber—fiber bonds. Another class of permanent-type wet strength agents includes aminoplast resins (e.g., urea-formaldehyde and melamine-formaldehyde).

If utilized, the permanent wet strength agents can be added in an amount between about 1 lb/T to about 20 lb/T, in some embodiments, between about 2 lb/T to about 10 lb/T, and in some embodiments, between about 3 lb/T to about 6 lb/T of the dry weight of fibrous material.

Temporary wet strength agents can also be useful in the present invention. Suitable temporary wet strength agents can be selected from agents known in the art such as dialdehyde starch, polyethylene imine, mannogalactan gum, glyoxal, and dialdehyde mannogalactan. Also useful are glyoxylated vinylamide wet strength resins as described in U.S. Pat. No. 5,466,337 to Darlington, et al., which is incorporated herein in its entirety by reference thereto for all purposes. Useful water-soluble resins include polyacrylamide resins such as those sold under the Parez trademark, such as Parez 631NC, by Cytec Industries, Inc. of Stanford, Conn. Such resins are generally described in U.S. Pat. No. 3,556,932 to Coscia, et al. and U.S. Pat. No. 3,556,933 to Williams, et al., which are incorporated herein in their entirety by reference thereto for all purposes. For example, the "Parez" resins typically include a polyacrylamide-glyoxal polymer that contains cationic hemiacetal sites that can form ionic bonds with carboxyl or hydroxyl groups present on the cellulosic fibers. These bonds can provide increased strength to the web of pulp fibers. In addition, because the hemicetal groups are readily hydrolyzed, the wet strength provided by such resins is primarily temporary.

U.S. Pat. No. 4,605,702 to Guerro, et al., which is incorporated herein in its entirety by reference thereto for all purposes, also describes suitable temporary wet strength resins made by reacting a vinylamide polymer with glyoxal, and then subjecting the polymer to an aqueous base treatment. Similar resins are also described in U.S. Pat. No. 4,603,176 to Biorkquist. et al.; U.S. Pat. No. 5,935,383 to Sun, et al.; and U.S. Pat. No. 6,017,417 to Wendt. et al., which are incorporated herein in their entirety by reference thereto for all purposes.

The temporary wet strength agents are generally provided by the manufacturer as an aqueous solution and, in some embodiments, is added in an amount between about 1 lb/T to about 60 lb/T, in some embodiments, between about 3 lb/T to about 4 lb/T, and in some embodiments, between about 4 lb/T to about 15 lb/T of the dry weight of fibrous material. If desired, the pH of the fibers can be adjusted prior to adding the resin. The Parez resins, for example, are typically used at a pH of from about 4 to about 8.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount in an amount between about 1 lb/T to about 30 lb/T, in some embodiments between about 3 lb/T to about 20 lb/T, and in some embodiments, between about 6 lb/T to about 15 lb/T of the dry weight of fibrous material. The debonder can be incorporated into any layer of the multi-layered paper web.

Any material that can be applied to fibers and that is capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty & carboxylic acid derivatives, mono- and polysaccharide derivatives, polyhydroxy hydrocarbons, etc. For instance, some suitable debonders are described in U.S. Pat. No. 5,716,498 to Jenny, et al.; U.S. Pat. No. 5,730,839 to Wendt, et al.; U.S. Pat. No. 6,211,139 to Keys, et al.; U.S. Pat. No. 5,543,067 to Phan, et al.; and WO/0021918, which are incorporated herein in their entirety by reference thereto for all purposes. For instance, Jenny, et al. and Phan, et al. describe various ester-functional quaternary ammonium debonders (e.g., quaternized fatty acid trialkanolamine ester salts) suitable for use in the present invention. In addition, Wendt. et al. describes imidazolinium quaternary debonders that may be suitable for use in the present invention. Further, Keys, et al. describes polyester polyquaternary ammonium debonders that may be useful in the present invention.

Still other suitable debonders are disclosed in U.S. Pat. No. 5,529,665 to Kaun and U.S. Pat. No. 5,558,873 to Funk, et al., which are incorporated herein in their entirety by reference thereto for all purposes. In particular, Kaun discloses the use of various cationic silicone compositions as softening agents.

The multi-layered web can generally be formed according to a variety of papermaking processes known in the art. In fact, any process capable of making a paper web can be utilized in the present invention. For example, a papermaking process of the present invention can utilize wet-pressing, creping, through-air-drying, creped through-air-drying, uncreped through-air-drying, single recreping, double recreping, calendering, embossing, air laying, as well as other steps in processing the paper web.

In some embodiments, in addition to the use of various chemical treatments, such as described above, the papermaking process itself can also be selectively varied to achieve a web with certain properties. For instance, a papermaking process can be utilized to form a multi-layered paper web, such as described and disclosed in U.S. Pat. No. 5,129,988 to Farrington, Jr.; U.S. Pat. No. 5,494,554 to Edwards, et al.; and U.S. Pat. No. 5,529,665 to Kaun, which are incorporated herein in their entirety by reference thereto for all purposes.

In this regard, various embodiments of a method for forming a multi-layered paper web will now be described in more detail. Referring to FIG. 1, a method of making a wet-pressed tissue in accordance with one embodiment of the present invention is shown, commonly referred to as couch forming, wherein two wet web layers are independently formed and thereafter combined into a unitary web. To form the first web layer, fibers (e.g., pulp and/or synthetic fibers) are prepared in a manner well known in the papermaking arts and delivered to the first stock chest 1, in which the fiber is kept in an aqueous suspension. A stock pump 2 supplies the required amount of suspension to the suction side of the fan pump 4. If desired, a metering pump 5 can supply an additive (e.g., latex, reactive composition, etc.) into the fiber suspension. Additional dilution water 3 also is mixed with the fiber suspension.

The entire mixture of fibers is then pressurized and delivered to a headbox 6. The aqueous suspension leaves the headbox 6 and is deposited on an endless papermaking fabric 7 over the suction box 8. The suction box is under vacuum that draws water out of the suspension, thus forming the first layer. In this example, the stock issuing from the headbox 6 would be referred to as the "air side" layer, that layer eventually being positioned away from the dryer surface during drying. In some embodiments, it may be desired for a layer containing the synthetic and pulp fiber blend to be formed as the "air side" layer. As will be described in more detail below, this may facilitate the ability of the synthetic fibers to remain below their melting point during drying.

The forming fabric can be any forming fabric, such as fabrics having a fiber support index of about 150 or greater. Some suitable forming fabrics include, but are not limited to, single layer fabrics, such as the Appleton Wire 94M available from Albany International Corporation, Appleton Wire Division, Menasha, Wis.; double layer fabrics, such as the Asten 866 available from Asten Group, Appleton, Wis.; and triple layer fabrics, such as the Lindsay 3080, available from Lindsay Wire, Florence, Miss.

The consistency of the aqueous suspension of papermaking fibers leaving the headbox can be from about 0.05 to about 2%, and in one embodiment, about 0.2%. The first headbox 6 can be a layered headbox with two or more layering chambers which delivers a stratified first wet web layer, or it can be a monolayered headbox which delivers a blended or homogeneous first wet web layer.

To form the second web layer, fibers (e.g., pulp and/or synthetic fibers) are prepared in a manner well known in the papermaking arts and delivered to the second stock chest 11, in which the fiber is kept in an aqueous suspension. A stock pump 12 supplies the required amount of suspension to the suction side of the fan pump 14. A metering pump 5 can supply additives (e.g., latex, reactive composition, etc.) into the fiber suspension as described above. Additional dilution water 13 is also mixed with the fiber suspension. The entire mixture is then pressurized and delivered to a headbox 16. The aqueous suspension leaves the headbox 16 and is deposited onto an endless papermaking fabric 17 over the suction box 18. The suction box is under vacuum which draws water out of the suspension, thus forming the second wet web. In this example, the stock issuing from the headbox 16 is referred to as the "dryer side" layer as that layer will be in eventual contact with the dryer surface. In some embodiments, it may be desired for a layer containing the synthetic and pulp fiber blend to be formed as the "dryer side" layer. As will be described in more detail below, this may facilitate the ability of the synthetic fibers to remain above their melting point during drying. Suitable forming fabrics for the forming fabric 17 of the second headbox include those forming fabrics previously mentioned with respect to the first headbox forming fabric.

After initial formation of the first and second wet web layers, the two web layers are brought together in contacting relationship (couched) while at a consistency of from about 10 to about 30%. Whatever consistency is selected, it is typically desired that the consistencies of the two wet webs be substantially the same. Couching is achieved by bringing the first wet web layer into contact with the second wet web layer at roll 19.

After the consolidated web has been transferred to the felt 22 at vacuum box 20, dewatering, drying and creping of the consolidated web is achieved in the conventional manner. More specifically, the couched web is further dewatered and transferred to a dryer 30 (e.g., Yankee dryer) using a pressure roll 31, which serves to express water from the web, which is absorbed by the felt, and causes the web to adhere to the surface of the dryer. The web is then dried, optionally creped and wound into a roll 32 for subsequent converting into the final creped product.

Figure 2:
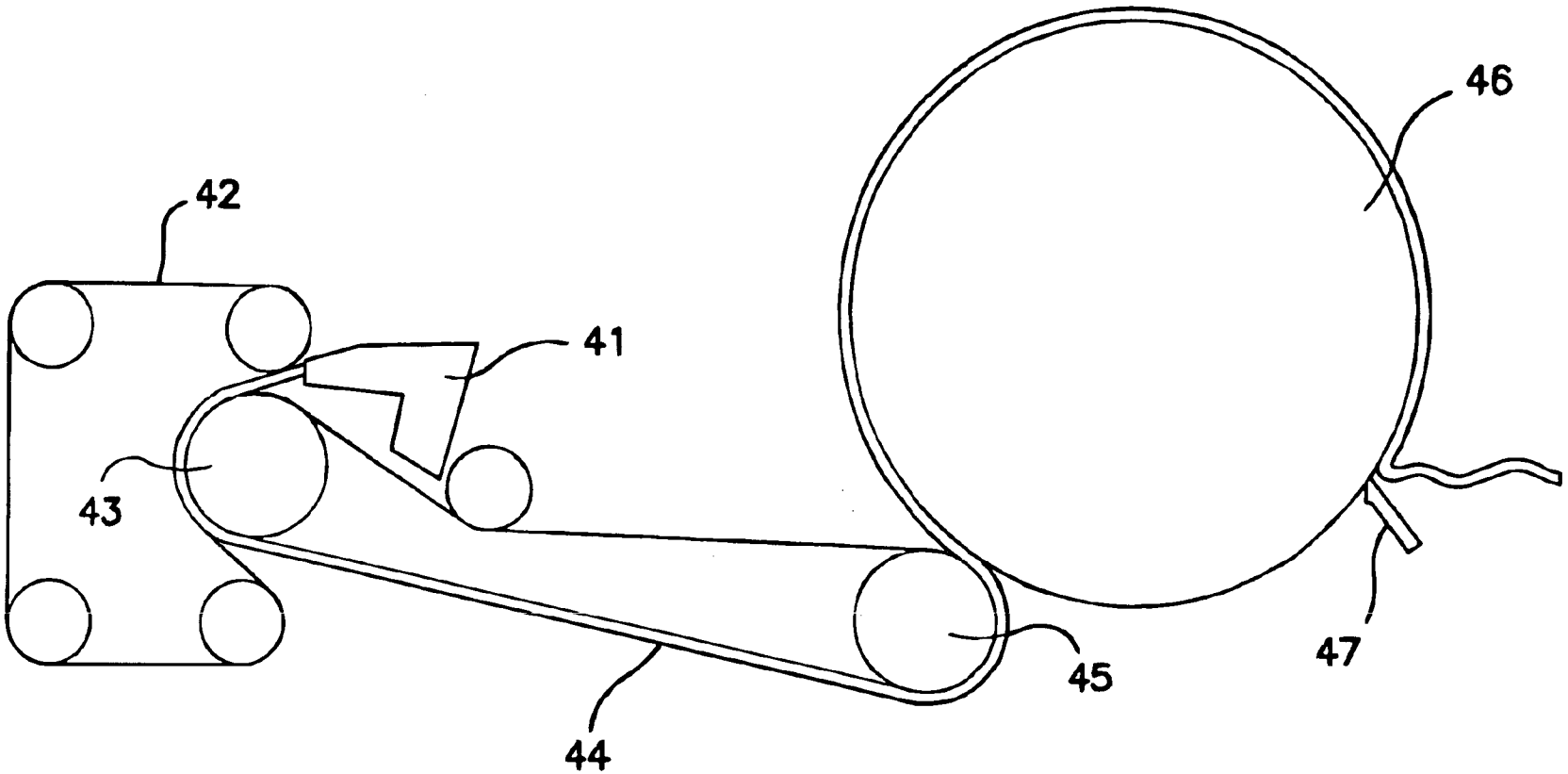
FIG. 2 is a schematic flow diagram of another embodiment of a papermaking process that can be used in the present invention.

FIG. 2 is a schematic flow diagram of another embodiment of a papermaking process than can be used in the present invention. For instance, a multi-layered headbox 41, a forming fabric 42, a forming roll 43, a papermaking felt 44, a press roll 45, a Yankee dryer 46, and a creping blade 47 are shown. Also shown, but not numbered, are various idler or tension rolls used for defining the fabric runs in the schematic diagram, which may differ in practice. In operation, a layered headbox 41 continuously deposits a layered stock jet between the forming fabric 42 and the felt 44, which is partially wrapped around the forming roll 43. Water is removed from the aqueous stock suspension through the forming fabric 42 by centrifugal force as the newly-formed web traverses the arc of the forming roll. As the forming fabric 42 and felt 44 separate, the wet web stays with the felt 44 and is transported to the Yankee dryer 46.

At the Yankee dryer 46, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer 46 is immediately following the creping doctor blade 47, permitting sufficient time for the spreading and drying of the film of fresh adhesive.

In some instances, various chemical compositions (e.g., debonding agents) may be applied to the web as it is being dried, such as through the use of the spray boom. For example, the spray boom can apply the additives to the surface of the drum 46 separately and/or in combination with the creping adhesives such that such additives are applied to an outer layer of the web as it passes over the drum 46. In some embodiments, the point of application on the surface of the dryer 46 is the point immediately following the creping blade 47, thereby permitting sufficient time for the spreading and drying of the film of fresh adhesive before contacting the web in the press roll nip. Methods and techniques for applying an additive to a dryer drum are described in more detail in U.S. Pat. No. 5,853,539 to Smith. et al. and U.S. Pat. No. 5,993,602 to Smith, et al., which are incorporated herein in their entirety by reference thereto for all purposes.

The wet web is applied to the surface of the dryer 46 by a press roll 45 with an application force of, in one embodiment, about 200 pounds per square inch (psi). Following the pressing or dewatering step, the consistency of the web is typically at or above about 30%. Sufficient Yankee dryer steam power and hood drying capability are applied to this web to reach a final consistency of about 95% or greater, and particularly 97% or greater. The sheet or web temperature immediately preceding the creping blade 47, as measured, for example, by an infrared temperature sensor, is typically about 235° F. or higher. For instance, when containing polyethylene/polyester or polyethylene/polypropylene bicomponent synthetic fibers, the sheet or web temperature is from about 255° F. to about 260° F. Besides using a Yankee dryer, it should also be understood that other drying methods, such as microwave or infrared heating methods, may be used in the present invention, either alone or in conjunction with a Yankee dryer.

The web can also be dried using non-compressive drying techniques, such as through-air drying. A through-air dryer accomplishes the removal of moisture from the web by passing air through the web without applying any mechanical pressure. Through-air drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes.

Figure 3:
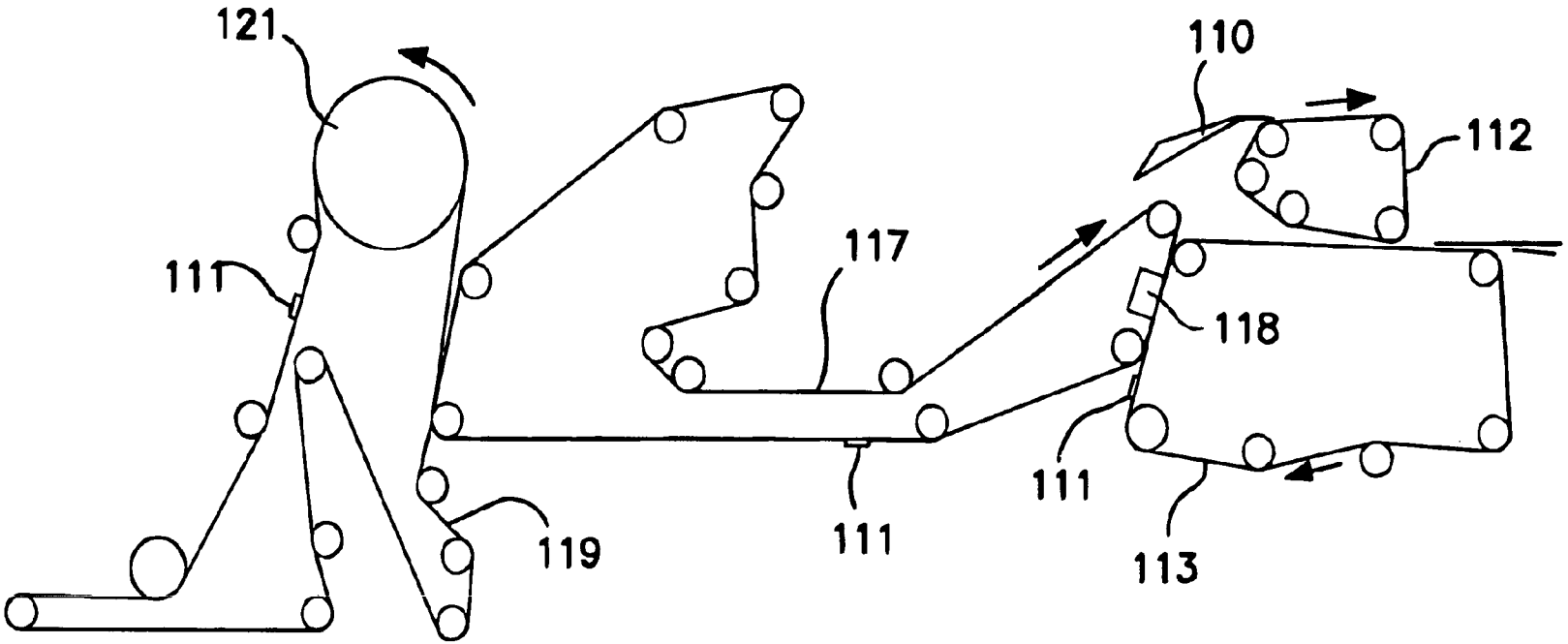
FIG. 3 is a schematic flow diagram of still another embodiment of a papermaking process that can be used in the present invention.

For example, referring to FIG. 3, one embodiment of a papermaking machine that can be used in forming an uncreped through-dried tissue product is illustrated. For simplicity, the various tensioning rolls schematically used to define the several fabric runs are shown but not numbered. As shown, a papermaking headbox 110 can be used to inject or deposit a stream of an aqueous suspension of papermaking fibers onto an upper forming fabric 112. The aqueous suspension of fibers is then transferred to a lower forming fabric 113, which serves to support and carry the newly-formed wet web 111 downstream in the process. If desired, dewatering of the wet web 111 can be carried out, such as by vacuum suction, while the wet web 111 is supported by the forming fabric 113.

The wet web 111 is then transferred from the forming fabric 113 to a transfer fabric 117 while at a solids consistency of between about 10% to about 35%, and particularly, between about 20% to about 30%. In this embodiment, the transfer fabric 117 is a patterned fabric having protrusions or impression knuckles, such as described in U.S. Pat. No. 6,017,417 to Wendt et al. Typically, the transfer fabric 117 travels at a slower speed than the forming fabric 113 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes.

Transfer to the fabric 117 may be carried out with the assistance of positive and/or negative pressure (e.g., vacuum). For example, in one embodiment, a vacuum shoe 118 can apply negative pressure such that the forming fabric 113 and the transfer fabric 117 simultaneously converge and diverge at the leading edge of the vacuum slot. Typically, the vacuum shoe 118 supplies pressure at levels between about 10 to about 25 inches of mercury. As stated above, the vacuum transfer shoe 118 (negative pressure) can be supplemented or replaced by the use of positive pressure from the opposite side of the web to blow the web onto the next fabric. In some embodiments, other vacuum shoes can also be used to assist in drawing the fibrous web 111 onto the surface of the transfer fabric 117.

From the transfer fabric 117, the fibrous web 111 is then transferred to the through-drying fabric 119. When the wet web 111 is transferred to the fabric 119. While supported by the through-drying fabric 119, the web 111 is then dried by a through-dryer 121 to a solids consistency of about 95% or greater. The through-dryer 121 accomplishes the removal of moisture from the web 111 by passing air therethrough without applying any mechanical pressure. Through-drying can also increase the bulk and softness of the web 111. In one embodiment, for example, the through-dryer 121 can contain a rotatable, perforated cylinder and a hood for receiving hot air blown through perforations of the cylinder as the through-drying fabric 119 carries the web 11 over the upper portion of the cylinder. The heated air is forced through the perforations in the cylinder of the through-dryer 121 and removes the remaining water from the web 111. The temperature of the air forced through the web 111 by the through-dryer 121 can vary, but is typically from about 200° F. to about 500° F. It should also be understood that other non-compressive drying methods, such as microwave or infrared heating, can be used.

In accordance with the present invention, it may sometimes be desired to select a certain drying temperature of the web (e.g., temperature of Yankee or through-air dryer) to control the degree of bonding between the synthetic fibers of the outer layer. For example, in some embodiments, the drying temperature may be less than the melting or softening point of one or more components of the synthetic fibers. In one particular embodiment, a web containing polyethylene/polyester bicomponent fibers is dried with a Yankee dryer at 230° F. The polyethylene has a melting or softening point of 279° F. and the polyester (polyethylene terephthalate) has a melting or softening point of 518° F. Thus, in this instance, less bonding would occur between adjacent synthetic fibers. Nevertheless, it has been discovered that relatively low bonded synthetic fibers can still provide a substantial reduction in the generation of lint and slough in a tissue product. Without being limited in theory, it is believed that the relatively long, low-bonded fibers, are able to entangle with the pulp fibers, thereby inhibiting their removal from the tissue product as lint or slough.

In other embodiments, it may be desired to impart a greater level of bonding between adjacent synthetic fibers. Thus, the drying temperature can simply be increased to become close to or surpass the melting point of one or more components of the synthetic fibers. For example, in one particular embodiment, a web containing polyethylene/polyester (PE/PET) bicomponent fibers is dried with a Yankee dryer at 280° F. The polyethylene has a melting or softening point of 279° F. and the polyester has a melting or softening point of 518° F. Thus, the PE/PET component of the synthetic fibers become softened and bond to adjacent synthetic fibers at their crossover points and to the pulp fibers. Such bonding can further increase the strength of the web, and also form a "network" that inhibits the generation of slough and lint in the resulting tissue product. Although control of the drying temperature is one technique for bonding the synthetic fibers, it should also be understood that other techniques may also be utilized in the present invention. For example, in some embodiments, the fibers may be heated to its bonding temperature after substantial drying has already occurred.

Thus, by having one or more layers that contain synthetic and pulp fibers, it has been discovered that lint and slough of a tissue product formed according to the present invention can be substantially reduced. For instance, although not limited in theory, it is believed that the relatively long synthetic fibers are able to entangle themselves around the relatively short pulp fibers, thereby inhibiting their removal from the surface of the tissue product by way of lint and/or slough. Further, the synthetic fibers may be softened and fuse to themselves and/or the pulp fibers to form a network that further reduces the lint and/or slough of the resulting tissue product. In addition, by limiting the amount and layers to which the synthetic fibers are applied, the increase in hydrophobicity and cost of the tissue product may be minimized, while still achieving the desired reduction in lint and slough. Further, by selecting synthetic fibers that have a density imbalance within a certain range, the tendency of the fibers to sink or float in the fibrous furnish may be minimized, thereby enhancing the processability of the web.

The present invention may be better understood with reference to the following examples.

Test Methods

The tensile strength, slough, stiffness, and lint of the samples set forth in the Examples were determined as follows.

Tensile Strength

Tensile strength was reported as "GMT" (grams per 3 inches of a sample), which is the geometric mean tensile strength and is calculated as the square root of the product of MD tensile strength and CD tensile strength. MD and CD tensile strengths were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4 inch gauge length for facial tissue and 2 inch gauge length for bath tissue. The crosshead speed during the test was 10 in./minute. The tester was connected with a computer loaded with data acquisition system; e.g., MTS TestWork for windows software. Readings were taken directly from a computer screen readout at the point of rupture to obtain the tensile strength of an individual sample.

Slough

Figure 4:
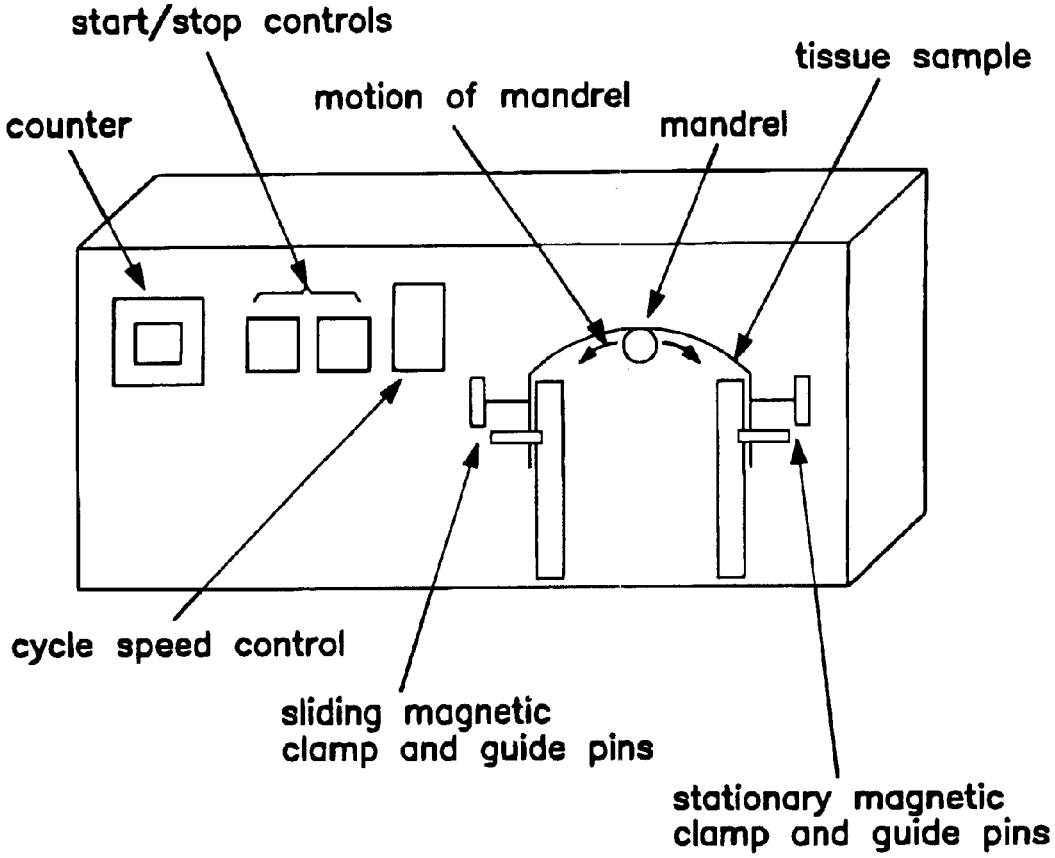
FIG. 4 is a schematic illustration of one example of an apparatus that can be used to measure the slough of a tissue product.

In order to determine the abrasion resistance or tendency of the fibers to be rubbed from the web when handled, each sample was measured by abrading the tissue specimens via the following method. This test measures the resistance of tissue material to abrasive action when the material is subjected to a horizontally reciprocating surface abrader. All samples were conditioned at 23° C.±1° C. and 50%±2% relative humidity for a minimum of 4 hours. FIG. 4 shows a diagram of the test equipment.

The abrading spindle contained a stainless steel rod, 0.5" in diameter with the abrasive portion consisting of a 0.005" deep diamond pattern extending 4.25" in length around the entire circumference of the rod. The spindle was mounted perpendicularly to the face of the instrument such that the abrasive portion of the rod extends out its entire distance from the face of the instrument. On each side of the spindle were located guide pins with magnetic clamps, one movable and one fixed, spaced 4" apart and centered about the spindle. The movable clamp and guide pins were allowed to slide freely in the vertical direction, the weight of the jaw providing the means for insuring a constant tension of the sample over the spindle surface.

Using a die press with a die cutter, the specimens were cut into 3"±0.05" wide×8" long strips with two holes at each end of the sample. For the tissue samples, the MD direction corresponds to the longer dimension. Each test strip was then weighed to the nearest 0.1 mg. Each end of the sample was slid onto the guide pins and magnetic clamps held the sheet in place. The movable jaw was then allowed to fall providing constant tension across the spindle.

The spindle was then moved back and forth at an approximate 15 degree angle from the centered vertical centerline in a reciprocal horizontal motion against the test strip for 20 cycles (each cycle is a back and forth stroke), at a speed of 80 cycles per minute, removing loose fibers from the web surface. Additionally, the spindle rotated counter clockwise (when looking at the front of the instrument) at an approximate speed of 5 RPMs. The magnetic clamp was then removed from the sample and the sample was slid off of the guide pins and any loose fibers on the sample surface are removed by blowing compressed air (approximately 5–10 psi) on the test sample. The test sample was then weighed to the nearest 0.1 mg and the weight loss calculated. Ten test samples per tissue sample were tested and the average weight loss value in milligrams was recorded.

Stiffness

Stiffness (or softness) was ranked on a scale from 0 to 16, where lower values represent softer tissues and higher values represent stiffer tissues. Twelve (12) panelists were asked to consider the amount of pointed, rippled or cracked edges or peaks felt from the sample while turning in your hand. The panelists were instructed to place two tissue samples flat on a smooth tabletop. The tissue samples overlapped one another by 0.5 inches (1.27 centimeters) and were flipped so that opposite sides of the tissue samples were represented during testing. With forearms/elbows of each panelist resting on the table, they placed their open hand, palm down, on the samples. Each was instructed to position their hand so their fingers were pointing toward the top of the samples, approximately 1.5 inches (approximately 3.81 centimeters) from the edge. Each panelist moved their fingers toward their palm with little or no downward pressure to gather the tissue samples. They gently moved the gathered samples around in the palm of their hand approximately 2 to 3 turns. The rank assigned by each panelist for a given tissue sample was then averaged and recorded.

Lint

Lint was ranked on a scale from 0 to 16, where lower values represent tissues with low lint and higher values represent tissues with higher lint. Twelve (12) panelists were asked to consider the amount of lint produced by a sample. Specifically, each panelist rubbed their thumb against the tissue samples and visually assessed the lint generated. The rank assigned by each panelist for a given tissue sample was then averaged and recorded.

EXAMPLE 1

The ability to form a paper web with low levels of lint and slough was demonstrated. Three samples (Samples 1–3) of a 2-ply tissue product in which each ply contained 3 layers were formed on a continuous former such as described above and shown in FIG. 2. The resulting composition of each layered basesheet was as follows:

(1) Outer Layer #1: 33 wt. % (eucalyptus+synthetic fibers in varying amounts);

(2) Inner Layer: 35 wt. % LL-19 (softwood fibers available from Kimberly-Clark); and (3) Outer Layer #2: 32 wt. % eucalyptus.

The synthetic fibers were Celbond® Type 105 polyethylene/polyester (PE/PET) fibers, which are available from Kosa, Inc. of Salisbury, N.C. These fibers had a denier of 3 and were cut to a length of 6 millimeters. The mass fraction of PE and PET was about 50%. The density of PE was about 0.91 g/cm$^3$ and the density of PET was about 1.38 g/cm$^3$, so that the resulting bicomponent density was about 1.15 g/cm$^3$, which compared to a density of about 1.3 g/cm$^3$ for pulp fibers and a density of about 1 g/cm$^3$ for water. The density imbalance ($\Delta\rho$), which is defined as the difference in density between the water and the fiber ($\Delta\rho=\rho_{water}-\rho_{fiber}$) was thus about −0.15 g/cm$^3$. The melting temperature of the PE sheath was about 279° F.

The synthetic fibers were incorporated into the eucalyptus pulp furnish as follow. First, water was heated to 100° F. in a pulper and transferred to a dump chest. The synthetic fibers were slowly poured in, mixed for 10 minutes, and transferred to a machine chest. The eucalyptus pulp fibers were then added into the machine chest and dilution completed. Kymene 557 LX was added to both the eucalyptus and softwood machine chests at 4 lb/Ton. Moreover, varying amounts of Parez 631 NC, a polyacrylamide temporary wet strength agent (also functions as a dry strength agent) available from Cytec Industries, Inc. of Stanford, Conn., were also added to the eucalyptus and softwood machine chests to achieve a target "GMT" strength of 750 grams per 3 inches.

The resulting furnishes were then transferred to a headbox and formed into a three-layered basesheet as set forth above. Once formed, the basesheet was dried with a Yankee dryer at a temperature of about 255° F. to allow partial thermofusing, and creped therefrom at a creping ratio of 1.3. Each sample was converted into a 2-ply facial tissue using conventional calendering in a steel nip, and then folding and cutting into individual facial tissues. The control sample (Sample 1) was calendered to have a thickness of 250 microns. Samples 2–3 were calendered at the same pressure.

The results are provided below in Table 1.

TABLE 1

Sample Results

| Sample | % Synthetic Fiber in Layer | % Synthetic Fibers per ply | GMT (grams/3 inches) | Slough (mg) | Panel Stiffness | Panel Lint | Basis Weight (g/m$^2$) |
|---|---|---|---|---|---|---|---|
| 1 | 0 | 0 | 690 | 5.3 | 4.5 | 10.9 | 30.9 |
| 2 | 5 | 1.65 | 584 | 1.5 | 4.6 | 7.20 | 31.2 |
| 3 | 10 | 3.30 | 944 | 0.4 | 5.8 | 4.40 | 34.5 |

As indicated from the results set forth in Table 1, the addition of synthetic fibers can provide a soft tissue product that is soft and produces relatively low amounts of lint and slough. For instance, a bicomponent fiber content of 5 wt. % and 10 wt. % decreased slough by factors 3.5 and 13.5, respectively. Moreover, the fused bicomponent fibers did not affect tissue rigidity or bulk to any significant extent.

EXAMPLE 2

The ability to form a paper web with low levels of lint and slough was demonstrated. Four samples (Samples 4–7) of a 2-ply tissue product in which each ply contained 2 layers were formed on a continuous former such as described above and shown in FIG. 1. The resulting composition of each layered basesheet was as follows:

(1) Outer Layer #1: 65 wt. % [80% eucalyptus and 20% synthetic fibers]; and (2) Outer Layer #2: 35 wt. % LL-19 softwood fibers (available from Kimberly-Clark).

The synthetic fibers were polyethylene/polypropylene (PE/PP) sheath/core (AL-Adhesion-C from ES Fibervision, Inc. of Athens, Ga.) having a denier of 1.9 and cut to length of 6 millimeters. The mass fraction of PE and PP was about 50%. The density of PE was 0.91 g/cm$^3$ and the density of PP was 0.94–0.96 g/cm$^3$, so that the resulting bicomponent fiber had a density of about 0.93 g/cm$^3$; which compared to a density of about 1.3 g/cm$^3$ for pulp fibers and about 1 g/cm$^3$ for water. The density imbalance ($\Delta\rho$), which is defined as the difference in density between the water and the fiber ($\Delta\rho=\rho_{water}-\rho_{fiber}$) was thus about +0.07 g/cm$^3$. The melting temperature the PE sheath was about 279° F.

The synthetic fibers were incorporated into the eucalyptus pulp furnish as follow. First, water was heated to 100° F. in a pulper and transferred to a dump chest. The synthetic fibers were slowly poured in, mixed for 10 minutes, and transferred to a machine chest. The eucalyptus pulp fibers were then added into the machine chest and dilution completed. Kymene 557 LX was added into both the eucalyptus and softwood machine chests at 4 lb/Ton.

The resulting furnishes were then transferred to a headbox and formed into a two-layered basesheet as set forth above at a forming velocity of 50 ft/min. Once formed, the basesheet was dried with a Yankee dryer at varying temperatures to allow partial thermofusing, and creped therefrom at a creping ratio of 1.3. Each sample was converted into a 2-ply facial tissue using conventional calendering in a steel nip, and then folding and cutting into individual facial tissues. The control sample (Sample 4) was calendered to have a thickness of 250 microns. Samples 5–7 were calendered at the same pressure.

The results are provided below in Table 2.

TABLE 2

Sample Results

| Sample | % Synthetic Fiber in Layer | % Synthetic Fibers per ply | Sheet Temp on Yankee (° F.) | GMT (grams/3 inches) | Slough (mg) | Panel Stiffness | Panel Lint | Basis Weight (g/m$^2$) |
|---|---|---|---|---|---|---|---|---|
| 4 | 0 | 0 | 217 | 1813 | 5.0 | 7.6 | 11.2 | 54.4 |
| 5 | 20 | 13 | 240 | 1733 | 3.2 | 7.4 | 9.68 | 63.0 |
| 6 | 20 | 13 | 255 | 2259 | 2.6 | 7.4 | 7.91 | 57.9 |
| 7 | 20 | 13 | 260 | 2382 | 1.3 | 8.9 | 4 | 60.2 |

As indicated from the results set forth in Table 2, the addition of synthetic fibers can provide a soft tissue product that is soft and produces relatively low amounts of lint and slough, independent of total tissue strength. For example, creping the basesheet containing 13% bicomponent fibers at a temperature of 260° F. decreased slough by a factor of 3.8, decreased Tinting by a factor 2.8, and increased strength by 31%.

EXAMPLE 3

The ability to form a paper web with low levels of lint and slough was demonstrated. Fourteen samples (Samples 8–21) of a 2-ply tissue product in which each ply contained 2 layers were formed on a continuous former such as described above and shown in FIG. 1.

The composition of each layered basesheet for Samples 8–14 and 17–19 was as follows:

(1) Outer Layer #1: 65 wt. % [eucalyptus and varying amounts of synthetic fibers]; and (2) Outer Layer #2: 35 wt. % LL-19 softwood fibers (available from Kimberly-Clark).

The composition of each layered basesheet for Samples 15–16 was as follows:

(1) Outer Layer #1: 65 wt. % eucalyptus; and (2) Outer Layer #2: 35 wt. % [LL-19 softwood fibers (available from Kimberly-Clark) and varying amounts of synthetic fibers)].

The composition of each layered basesheet for Samples 20–21 was as follows:

(1) Outer Layer #1: 65 wt. % eucalyptus; and (2) Outer Layer #2: 35 wt. % LL-19 softwood fibers (available from Kimberly-Clark).

Two types of synthetic fibers were tested. The first type of fibers was Celbond® Type 105 polyethylene/polyester (PE/PET) fibers, available from Kosa of Salisbury, N.C. These fibers had a denier of 3 and were cut to lengths of 6 and 12 millimeters. The mass fraction of PE and PET was about 50%. The density of PE was about 0.91 g/cm$^3$ and the density of PET was about 1.38 g/cm$^3$, so that the resulting bicomponent density was 1.15 g/cm$^3$, which compared to a density of about 1.3 g/cm$^3$ for pulp fibers and a density of about 1 g/cm$^3$ for water. The density imbalance ($\Delta\rho$), which is defined as the difference in density between the water and the fiber ($\Delta\rho=\rho_{water}-\rho_{fiber}$) was thus about −0.15 glcm$^3$. The melting temperature of the PE sheath was about 279° F.

The second type of fibers was polyethylene/polypropylene (PE/PP) sheath/core (AL-Adhesion-C from ES Fibervision, Inc. of Athens, Ga.). These fibers had a denier of 1.9 and were cut to a length of 4, 6, and 12 millimeters. The mass fraction of PE and PP was about 50%. The density of PE was about 0.91 g/cm$^3$ and the density of PET was 0.94–0.96 g/cm$^3$, so that the resulting bicomponent fiber had a density of about 0.93 g/cm$^3$; which compared to a density of about 1.3 g/cm$^3$ for pulp fibers and about 1 g/cm$^3$ for water. The density imbalance ($\Delta\rho$), which is defined as the difference in density between the water and the fiber ($\Delta\rho=\rho_{water}-\rho_{fiber}$) was thus about +0.07 g/cm$^3$. The melting temperature of the PE sheath was about 279° F.

The synthetic fibers were incorporated into the applicable pulp furnish as follow. First, water was heated to 100° F. in a pulper and transferred to a dump chest. The synthetic fibers were slowly poured in, mixed for 10 minutes, and transferred to a machine chest. The pulp fibers were then added into the machine chest and dilution completed. Kymene 557 LX was added to both the eucalyptus and softwood machine chests at 4 lb/Ton. Also, for Samples 20 and 21, an imidazoline softener (Prosoft TQ-1003, Hercules, Inc.) was incorporated in the eucalyptus machine chest in an amount of 5 lb/ton and 10 lb/ton, respectively.

The resulting furnishes were then transferred to a headbox and formed into a two-layered basesheet as set forth above at a forming velocity of 50 ft/min. Once formed, the basesheet was dried with a Yankee dryer at a temperature of 215–225° F. to prevent thermofusing, and creped therefrom at a creping ratio of 1.3. Each sample was converted into a 2-ply facial tissue using conventional calendering in a steel nip, and then folding and cutting into individual facial tissues. The control sample (Sample 8) was calendered to have a thickness of 250 microns. Samples 9–21 were calendered at the same pressure.

The results are provided below in Table 3.

TABLE 3

| | | | | Sample Results | | | | | |
|---|---|---|---|---|---|---|---|---|---|
| Sample | % Synthetic Fiber in Layer | % Synthetic Fibers per ply | Fiber Length (mm) | Layer Applied With Synthetic Fibers | GMT (grams/3 inches) | Slough (mg) | Stiffness | Panel Lint | Basis Weight (g/m$^2$) |
| 8 | 0 | 0 | — | — | 1969 | 5.4 | 8.2 | 13.0 | 54.7 |
| 9 | 5 | 3.2 | 6 | Euc | 1794 | 2.9 | 7.6 | 11.9 | 58.1 |
| 10 | 10 | 6.5 | 6 | Euc | 1722 | 2.2 | 7.6 | 11.7 | 55.5 |
| 11 | 20 | 13.0 | 6 | Euc | 1558 | 1.5 | 6.7 | 11.0 | 53.5 |
| 12 | 5 | 3.2 | 12 | Euc | 1837 | 3.3 | 7.3 | 12.2 | 55.9 |
| 13 | 10 | 6.5 | 12 | Euc | 1721 | 1.9 | 6.5 | 11.6 | 56.6 |
| 14 | 20 | 13.0 | 12 | Euc | 1778 | 1.1 | 7.0 | 10.6 | 55.8 |
| 15 | 10 | 6.5 | 12 | LL-19 | 1311 | 3.9 | 6.4 | 12.9 | 57.2 |
| 16 | 20 | 13.0 | 12 | LL-19 | 1049 | 4.2 | 6.0 | 12.6 | 57.9 |
| 17 | 20 | 13.0 | 4 | Euc | 1450 | 2.6 | 6.1 | 12.6 | 52.9 |
| 18 | 20 | 13.0 | 6 | Euc | 1448 | 2.2 | 6.3 | 10.1 | 54.9 |
| 19 | 20 | 13.0 | 12 | Euc | 1715 | 2.6 | 7.3 | 9.9 | 55.8 |
| 20 | 0 | 0 | — | — | 1066 | 12.9 | 4.5 | 14.7 | 51.5 |
| 21 | 0 | 0 | — | — | 1039 | 12.9 | 4.6 | 14.5 | 50.4 |

As indicated from the results set forth in Table 3, the addition of unfused synthetic fibers can provide a tissue product that is soft and produces relatively low amounts of lint and slough. In this particular instance, the unfused bicomponent fibers appeared to be more effective in the eucalyptus layer than in the LL-19 layer for slough and lint reduction, which suggests that surface entanglement of bicomponent fibers is effective to decrease slough. In addition, as evidenced by Samples 15–16, the addition of synthetic fibers to the LL-19 layer can also result in reduced slough and stiffness in the tissue product.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A tissue product comprising:

at least one multi-layered paper web that includes a first fibrous layer and a second fibrous layer, wherein said first fibrous layer comprises hardwood pulp fibers and said second fibrous layer comprises softwood pulp fibers, wherein said first fibrous layer, further comprises synthetic fibers in an amount from about 0.1% to about 25% by weight of said layer, wherein said synthetic fibers have a density imbalance of from about −0.2 to about +0.5 grams per cubic centimeter, and wherein the total amount of synthetic fibers present within said web is from about 0.1% to about 20% by weight.

2. A tissue product as defined in claim 1, wherein said second fibrous layer consists essentially of said softwood fibers or a blend of said softwood fibers and hardwood fibers.

3. A tissue product as defined in claim 1, wherein synthetic fibers are also present within said second fibrous layer.

4. A tissue product as defined in claim 1, wherein said first fibrous layer is positioned adjacent to said second fibrous layer.

5. A tissue product as defined in claim 1, further comprising a third fibrous layer that comprises softwood fibers, hardwood fibers, or combinations thereof.

6. A tissue product as defined in claim 5, wherein said third fibrous layer further comprises synthetic fibers in an amount from about 0.1% to about 25% by weight of said third fibrous layer.

7. A tissue product as defined in claim 1, wherein said synthetic fibers have a length of from about 0.5 to about 30 millimeters.

8. A tissue product as defined in claim 1, wherein said synthetic fibers have a length of from about 4 to about 8 millimeters.

9. A tissue product as defined in claim 1, wherein said synthetic fibers comprise from about 0.1% to about 10% by weight of said layer.

10. A tissue product as defined in claim 1, wherein said synthetic fibers comprise from about 2% to about 5% by weight of said layer.

11. A tissue product as defined in claim 1, wherein the total amount of synthetic fibers present within said web is from about 0.1% to about 10% by weight.

12. A tissue product as defined in claim 1, wherein the total amount of synthetic fibers present within said web is from about 0.1% to about 2% by weight.

13. A tissue product as defined in claim 1, wherein said synthetic fibers are multicomponent fibers.

14. A tissue product as defined in claim 1, wherein said synthetic fibers are bicomponent fibers having a sheath/core configuration.

15. A tissue product as defined in claim 1, wherein at least a portion of said synthetic fibers are fused together.

16. A tissue product as defined in claim 1, wherein at least a portion of said synthetic fibers are unfused.

17. A tissue product as defined in claim 1, wherein said multi-layered web forms a first ply.

18. A tissue product as defined in claim 17, wherein a second ply is positioned adjacent to said first ply.

19. A tissue product as defined in claim 1, wherein the density imbalance of said synthetic fibers is from about −0.2 to about +0.4 grams per cubic centimeter.

20. A tissue product as defined in claim 1, wherein the density imbalance of said synthetic fibers is from about −0.1 to about +0.4 grams per cubic centimeter.

21. A single-ply tissue product comprising an inner layer positioned between a first outer layer and a second outer layer, wherein said inner layer comprises softwood fibers and said first and second outer layers comprise hardwood pulp fibers, wherein said first outer layer, said second outer layer, or combinations thereof, further comprise synthetic fibers in an amount from about 0.1% to about 25% by weight of said layer, wherein said synthetic fibers have a density imbalance of from about 0.2 to about +0.4 grams per cubic centimeter, and wherein the total amount of synthetic fibers present within the tissue product is from about 0.1% to about 20% by weight.

22. A single-ply tissue product as defined in claim 21, wherein said inner layer consists essentially of said softwood fibers or a blend of said softwood fibers and hardwood fibers.

23. A single-ply tissue product as defined in claim 21, wherein said synthetic fibers comprise from about 0.1% to about 10% by weight of said first and second outer layers or combinations thereof.

24. A single-ply tissue product as defined in claim 21, wherein said synthetic fibers comprise from about 2% to about 5% by weight of said first and second outer layers or combinations thereof.

25. A single-ply tissue product as defined in claim 21, wherein the total amount of synthetic fibers present within the tissue product is from about 0.1% to about 10% by weight.

26. A single-ply tissue product as defined in claim 21, wherein the total amount of synthetic fibers present within the tissue product is from about 0.1% to about 2% by weight.

27. A single-ply tissue product as defined in claim 21, wherein said synthetic fibers are bicomponent fibers.

28. A multi-ply tissue product, comprising:

(a) a first ply, the first ply comprising:

a first fibrous layer, wherein said first fibrous layer comprises hardwood pulp fibers and synthetic fibers in an amount from about 0.1% to about 25% by weight of said layer, wherein said synthetic fibers have a density imbalance of from about −0.2 to about +0.4 grams per cubic centimeter, and wherein the total amount of synthetic fibers present within said first ply is from about 0.1% to about 20% by weight; and a second fibrous layer positioned adjacent to said first fibrous layer, said second fibrous layer comprising softwood pulp fibers;

(b) a second ply comprising at least one fibrous layer.

29. A multi-ply tissue product as defined in claim 28, wherein said synthetic fibers comprise from about 2% to about 5% by weight of said first fibrous layer.

30. A multi-ply tissue product as defined in claim 28, wherein the total amount of synthetic fibers present within said first ply is from about 0.1% to about 2% by weight.

31. A multi-ply tissue product as defined in claim 28, wherein said synthetic fibers are multicomponent fibers.

32. A multi-ply tissue product as defined in claim 28, wherein said second fibrous layer consists essentially of said softwood fibers or a blend of said softwood fibers and hardwood fibers.

33. A multi-ply tissue product as defined in claim 28, wherein synthetic fibers are also present in said second fibrous layer.

* * * * *

UNITED STATES PATENT AND TRADEMARK OFFICE

CERTIFICATE OF CORRECTION

PATENT NO. : 6,861,380 B2
APPLICATION NO. : 10/289129
DATED : March 1, 2005
INVENTOR(S) : Gil Bernard Didier Garnier and Sheng-Hsin Hu It is certified that error appears in the above-identified patent and that said Letters Patent is hereby corrected as shown below:

Column 21, line 49, ""fibers, wherein said first fibrous layer, further com-" should be --"fibers, wherein said first fibrous layer further com-"--
Column 23, line 7, "imbalance of from about 0.2 to about +0.4 grams per cubic" should be --"imbalance of from about -0.2 to about +0.4 grams per cubic"--

Signed and Sealed this

Sixth Day of February, 2007

JON W. DUDAS
*Director of the United States Patent and Trademark Office*